US007408400B1

(12) United States Patent
DeStasi

(10) Patent No.: US 7,408,400 B1
(45) Date of Patent: Aug. 5, 2008

(54) SYSTEM AND METHOD FOR PROVIDING A LOW VOLTAGE BANDGAP REFERENCE CIRCUIT

(75) Inventor: Frank DeStasi, San Leandro, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 50 days.

(21) Appl. No.: 11/504,976

(22) Filed: Aug. 16, 2006

(51) Int. Cl.
*G05F 1/10* (2006.01)

(52) U.S. Cl. ..... 327/539; 327/538; 323/313

(58) Field of Classification Search ..... 327/539, 327/542, 541, 538; 323/313
See application file for complete search history.

(56) References Cited

U.S. PATENT DOCUMENTS 5,818,292 A * 10/1998 Slemmer ..... 327/539
5,834,926 A * 11/1998 Kadanka ..... 323/313
5,973,550 A * 10/1999 Bowers et al. ..... 327/541
6,052,020 A 4/2000 Doyle
6,225,850 B1 * 5/2001 Opris ..... 327/356
6,380,723 B1 4/2002 Sauer
6,462,526 B1 * 10/2002 Tanase ..... 323/313
6,617,836 B1 9/2003 Doyle et al.
6,677,808 B1 1/2004 Sean et al.
6,828,847 B1 12/2004 Marinca
6,885,179 B1 4/2005 Ker et al.

OTHER PUBLICATIONS

Hironori Banba et al., "A CMOS Band-Gap Reference Circuit with Sub 1V Operation," 1998 IEEE, Symposium on VLSI Circuits Digest of Technical Papers, pp. 228-229.

A. Cabrini et al., "A I V, 26μW Extended Temperature Range Band-Gap Reference in 130-nm CMOS Technology," Proceedings of ESSCIRC, Grenoble, France, 2005 IEEE, pp. 503-506.

* cited by examiner

*Primary Examiner*—Dinh T. Le

(57) ABSTRACT

A system and method are disclosed for providing a low voltage bandgap reference circuit that provides a substantially constant output voltage over a range of values of temperature. For example, the bandgap reference circuit could be capable of providing output voltages that are as low as one hundred millivolts. Also, no special start-up circuitry may be required to initiate the operation of the bandgap reference circuit. The bandgap reference circuit could further require fewer transistors and fewer resistors than prior art bandgap reference circuits.

20 Claims, 1 Drawing Sheet

SYSTEM AND METHOD FOR PROVIDING A LOW VOLTAGE BANDGAP REFERENCE CIRCUIT

TECHNICAL FIELD OF THE INVENTION

The present invention is generally directed to the manufacture of bandgap reference circuits and, in particular, to a system and method for providing an improved low voltage bandgap reference circuit.

BACKGROUND OF THE INVENTION

A bandgap reference circuit is commonly used to provide a reference voltage in electronic circuits. A reference voltage must provide the same voltage every time the electronic circuit is powered up. In addition, the reference voltage must remain constant and independent of variations in temperature, fabrication process, and supply voltage.

A bandgap reference circuit relies on the predictable variation with temperature of the bandgap energy of an underlying semiconductor material (usually silicon). The energy bandgap of silicon is on the order of one and two tenths volt (1.2 V). Some types of prior art bandgap reference circuits use the bandgap energy of silicon in bipolar junction transistors to compensate for temperature effects.

As the design dimensions of electronic circuit elements decrease, the magnitude of the power supply voltages have also decreased. Lower power supply voltages reduce the total power requirements of an electronic circuit. This is especially important in electronic circuits that operate on battery power. Electronic circuits that use lower supply voltages also require bandgap reference circuits that provide lower reference voltages.

Therefore, there is a need in the art for a bandgap reference circuit that is capable of providing a low reference voltage. Specifically, there is a need in the art for an improved low voltage bandgap reference circuit that can provide a reference voltage having a magnitude less than one and two tenths volts (1.2 V).

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior uses, as well as to future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 1:
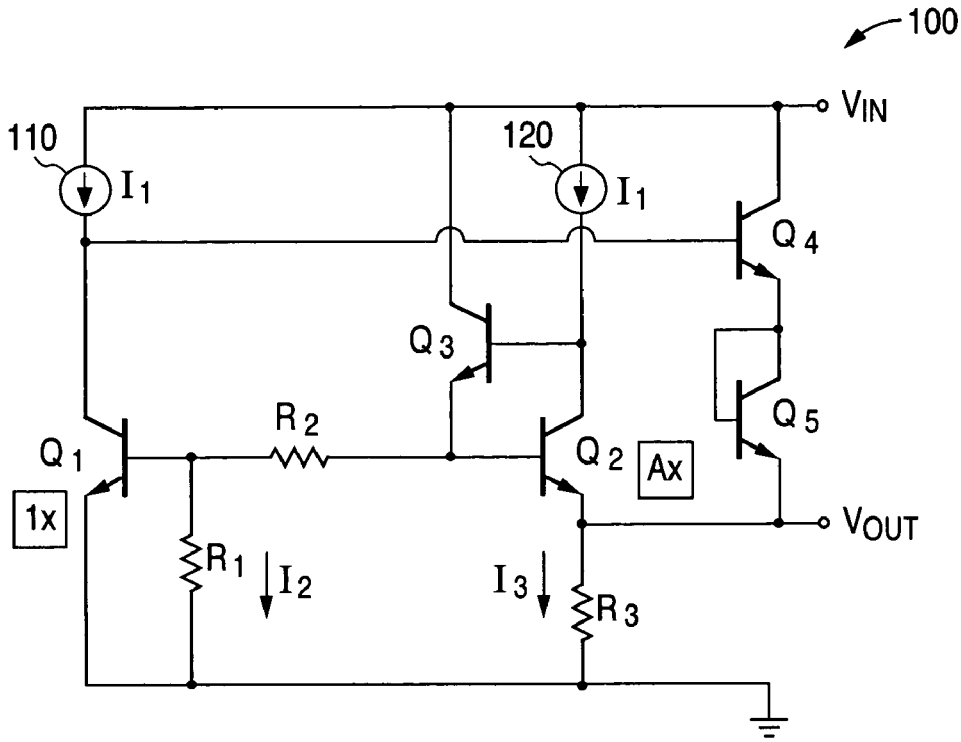
FIG. 1 illustrates a schematic representation of a first embodiment of a low voltage bandgap reference circuit of the present invention.
Figure 2:
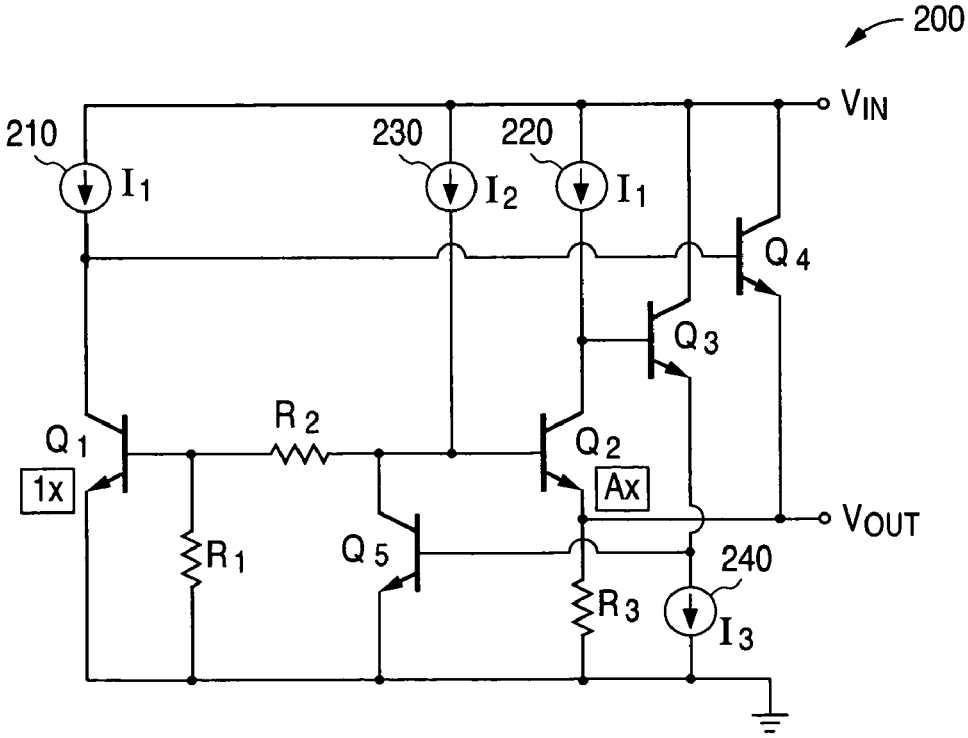
FIG. 2 illustrates a schematic representation of a second embodiment of a low voltage bandgap reference circuit of the present invention.

FIGS. 1 and 2, discussed below, and the various embodiments used to describe the principles of the present invention in this patent document are by way of illustration only and should not be construed in any way to limit the scope of the invention. Those skilled in the art will understand that the principles of the present invention may be implemented with any type of suitably arranged bandgap reference circuit.

FIG. 1 illustrates a schematic representation of a first embodiment of a low voltage bandgap reference circuit 100 constructed in accordance with the principles of the present invention. The input voltage $V_{IN}$ is connected to a first current source 110 that produces a current having a value of $I_1$ and to a second current source 120 that also produces a current having a value of $I_1$. As shown in FIG. 1, the input voltage $V_{IN}$ is also connected to the collector of bipolar junction transistor $Q_3$ and to the collector of bipolar junction transistor $Q_4$.

The output of first current source 110 is connected to the collector of bipolar junction transistor $Q_1$. The output of first current source 110 is also connected to the base of bipolar junction transistor $Q_4$. The output of second current source 120 is connected to the collector of bipolar junction transistor $Q_2$. The output of second current source 120 is also connected to the base of bipolar junction transistor $Q_3$. The emitter of bipolar junction transistor $Q_3$ is connected to the base of bipolar junction transistor $Q_2$. The emitter of bipolar junction transistor $Q_3$ is also connected through resistor $R_2$ to the base of bipolar junction transistor $Q_1$.

The emitter of bipolar junction transistor $Q_1$ is connected to ground. A first end of resistor $R_1$ is connected to the base of bipolar junction transistor $Q_1$ and a second end of resistor $R_1$ is connected to ground. The current that flows through resistor $R_1$ is designated as $I_2$.

The emitter of bipolar junction transistor $Q_2$ is connected to the voltage output terminal $V_{OUT}$. The emitter of bipolar junction transistor $Q_2$ is also connected through resistor $R_3$ to ground. The current that flows through resistor $R_3$ is designated as $I_3$.

The emitter of bipolar junction transistor $Q_4$ is connected to the collector of bipolar junction transistor $Q_5$. The base of bipolar junction transistor $Q_5$ is connected to a node between the emitter of bipolar junction transistor $Q_4$ and the collector of bipolar junction transistor $Q_5$. The emitter of bipolar junction transistor $Q_5$ is connected to the voltage output terminal $V_{OUT}$.

The output voltage $V_{OUT}$ is the sum of the voltage across resistor $R_2$ and the difference between the base-emitter voltage $V_{BE}$ of transistor $Q_1$ and transistor $Q_2$. The current through transistor $Q_1$ is equal to $I_1$ and the current through transistor $Q_2$ is also equal to $I_1$.

The area of transistor $Q_1$ is equal to a unit value of area. That is, the transistor $Q_1$ has a value of area equal to one square unit (designated "1x" in FIG. 1). The area of transistor $Q_2$ is equal to "A" times the area of transistor $Q_1$. That is, transistor $Q_2$ has a value of area equal to A square units of area (designated "Ax" in FIG. 1).

With equal currents ($I_1$) through transistor $Q_1$ and through transistor $Q_2$ and with an area ratio of "one" to "A" (1:A), the difference voltage ($\Delta V_{BE}$) is given by the expression:

$$\Delta V_{BE} = V_T \ln(A) \quad \text{(Eq. 1)}$$

where the term $V_T$ represents the thermal voltage of the transistor at the absolute temperature T.

The current $I_2$ flows through resistor $R_1$. Ignoring the base currents in transistor $Q_1$ and in transistor $Q_2$, the value of current flowing through transistor $R_2$ is also $I_2$. Transistor $Q_3$ supplies the $I_2$ current and the value of the current $I_2$ is given by the expression:

$$I_2 = \frac{V_{BEQ_1}}{R_1} \quad \text{(Eq. 2)}$$

where the term $V_{BEQ_1}$ represents the base-emitter voltage of transistor $Q_1$. This means that the voltage $V_{R_2}$ across resistor $R_2$ is given by the expression:

$$V_{R_2} = \frac{R_2}{R_1} V_{BEQ_1} \quad \text{(Eq. 3)}$$

Adding the PTAT (Proportional to Absolute Temperature) difference voltage ($\Delta V_{BE}$) to the voltage $V_{R_2}$ across resistor $R_2$ provides a first order temperature independent output voltage $V_{OUT}$.

$$V_{OUT} = \Delta V_{BE} + V_{R_2} \quad \text{(Eq. 4)}$$

$$V_{OUT} = V_T \ln(A) + \left(\frac{R_2}{R_1}\right) V_{BEQ_1} \quad \text{(Eq. 5)}$$

Transistor $Q_3$ supplies the current $I_2$ and controls the bases of transistor $Q_1$ and transistor $Q_2$ to keep the collector of transistor $Q_2$ at a voltage value of $2V_{BE}+V_{OUT}$. Transistor $Q_4$ and transistor $Q_5$ control the output voltage $V_{OUT}$ to keep the collector of transistor $Q_1$ at a voltage value of $2V_{BE}+V_{OUT}$. Transistor $Q_5$ is only used to balance the collector voltages of transistor $Q_1$ and transistor $Q_2$.

The current $I_3$ flows through resistor $R_3$. The value of resistance of resistor $R_3$ should be selected to provide a current value of approximately $I_1$ through transistor $Q_4$ and transistor $Q_5$. The absolute value of the current $I_3$ is not critical.

The value of the resistance of resistor $R_3$ is approximately equal to the output voltage $V_{OUT}$ divided by the sum of the current $I_1$ plus the current through transistor $Q_4$. Because the value of the current through transistor $Q_4$ is approximately equal to the current $I_1$, the approximate value of the resistance of resistor $R_3$ is given by the expression:

$$R_3 \cong \frac{V_{OUT}}{(I_1 + I_{Q4})} \cong \frac{V_{OUT}}{2I_1} \quad \text{(Eq. 6)}$$

The minimum value of the input voltage $V_{IN}$ for bandgap reference circuit 100 is given by the expression:

$$V_{IN}(\text{minimum}) = 2V_{BE} + V_{SAT} + V_{OUT} \quad \text{(Eq. 7)}$$

The term $V_{BE}$ represents a value of base to emitter voltage of said first bipolar junction transistor $Q_1$. The term $V_{SAT}$ represents a minimum voltage required for the current sources (110, 120). The term $V_{OUT}$ represents the output voltage. The currents $I_1$ in the current sources (110, 120) may be constant or they may be proportional to absolute temperature (PTAT). Typical values of $V_{IN}$ (minimum) are in the range of one and eight tenths volt (1.8 V) to two volts (2.0 V).

The low voltage bandgap reference circuit 100 of the present invention provides a low value of output voltage $V_{OUT}$ that is constant with temperature over a pre-selected range of temperature values. The value of output voltage $V_{OUT}$ can be significantly less than one and two tenths volt (1.2 V). The value of output voltage $V_{OUT}$ can be as low as approximately one hundred millivolts (100 mV). The lowest value of output voltage $V_{OUT}$ achievable by prior art devices is approximately two hundred millivolts (200 mV).

The value of output voltage $V_{OUT}$ that is provided by the low voltage bandgap reference circuit 100 of the present invention depends on the ratio of the value of the resistance of the $R_1$ resistor to the value of the resistance of the $R_2$ resistor ($R_1/R_2$). The value of the resistance of the $R_3$ resistor is not critical. No special start-up circuitry is required to operate the low voltage bandgap reference circuit 100 of the present invention. Start-up is initiated simply by supplying the $I_1$ currents.

The optimal values of the resistances of the resistors ($R_1$, $R_2$ and $R_3$) may be selected using the analysis set forth below. The basic equation for the base-emitter voltage $V_{BE}$ for the bipolar junction transistor $Q_1$ is:

$$V_{BEQ_1} = E_{GE} - H(E_{GE} - V_{BE_o}) + V_{To} H \ln\left(\frac{I_1}{I_0}\right) - \eta V_{To} H \ln(H) \quad \text{(Eq. 8)}$$

The expression $E_{GE}$ represents the silicon bandgap voltage. A typical value for the silicon bandgap voltage is approximately one and two tenths volt (1.2 V). The letter H represents the ratio of the absolute temperature T to the room temperature $T_0$.

$$H = \frac{T}{To} \quad \text{(Eq. 9)}$$

The room temperature $T_0$ is equal to twenty seven degrees Celsius (27° C.) and equal to three hundred degrees Kelvin (300° K.). The expression $I_1$ represents the current through transistor $Q_1$ at the temperature T. The expression $I_0$ represents the current through transistor $Q_1$ at room temperature $T_0$.

The expression $V_{BE_0}$ represents the value of base-emitter voltage $V_{BE}$ of transistor $Q_1$ when the temperature is room temperature $T_0$ (and the current through transistor $Q_1$ is $I_0$). The expression $V_{T_0}$ represents the thermal voltage at room temperature $T_0$.

$$V_{T_0} = \frac{kT_0}{q} \cong 26 \text{ millivolts} \quad \text{(Eq. 10)}$$

The letter k represents Boltzmann's constant and the letter q represents the electron charge. The Greek letter η in Equation 8 represents the exponent of T in the saturation current of transistor $Q_1$. The expression η is referred to as XTI in the SPICE™ circuit simulation program and has a value of approximately four (4) for diffused silicon junctions.

We use the expression for $V_{BE\,Q_1}$ of Equation 8 in Equation 5 (reproduced below):

$$V_{OUT} = V_T \ln(A) + \left(\frac{R_2}{R_1}\right)V_{BEQ_1} \quad \text{(Eq. 5)}$$

For convenience, ratio $R_2/R_1$ will be represented by the Greek letter α. The letter H also represents the ratio of the thermal voltage $V_T$ at the absolute temperature T to the thermal voltage $V_{T_0}$ at room temperature $T_0$.

$$H = \frac{V_T}{V_{T_0}} \quad \text{(Eq. 11)}$$

Using these expressions, Equation 5 becomes:

$$V_{OUT}=V_{T_0}H\ln(A)+\alpha V_{BE\,Q_1} \quad \text{(Eq. 12)}$$

The goal is to find a value for the ratio α and a value for the area A such that the partial derivative of $V_{OUT}$ with respect to H is zero.

$$\frac{\partial V_{OUT}}{\partial H} = 0 \quad \text{(Eq. 13)}$$

For a current $I_1$ that is proportional to absolute temperature (PTAT), the letter H also represents the ratio of the current $I_1$ at the absolute temperature T to the current $I_0$ at room temperature $T_0$.

$$H = \frac{I_1}{I_0} \quad \text{(Eq. 14)}$$

Using Equation 8 and Equation 14 one may express Equation 12 as follows:

$$V_{OUT}=\alpha\lfloor E_{GE}-H(E_{GE}-V_{BE_0})+V_{T_0}H\ln(H)-\eta V_T H\ln(H)\rfloor+V_{T_0}H\ln \quad \text{(Eq. 15)}$$

Taking the derivative with respect to H gives:

$$\frac{\partial V_{OUT}}{\partial H} = \alpha[-(E_{GE} - V_{BE_0}) + V_{T_0}(1 + \ln(H))(-\eta + 1)]V_{T_0}\ln(A) \quad \text{(Eq. 16)}$$

Setting the derivative in Equation 16 equal to zero and evaluating at H=1 gives:

$$\alpha\lfloor-(E_{GE}-V_{BE_0})-V_{T_0}(\eta-1)\rfloor+V_{T_0}\ln(A)=0 \quad \text{(Eq. 17)}$$

This gives an expression for α as follows:

$$\alpha = \frac{V_{T_0}\ln(A)}{(E_{GE} - V_{BE_0}) + V_{T_0}(\eta - 1)} \quad \text{(Eq. 18)}$$

This result for α is placed into Equation 12 in order to find the value of $V_{OUT}$ where H equals one. The value of $V_{OUT}$ when the value of H equals one will be referred to as the "magic" voltage. When the value of H equals one, then Equation 12 reduces to:

$$V_{OUT}=V_{magic}=V_{T_0}\ln(A)+\alpha V_{BE_0} \quad \text{(Eq. 19)}$$

Substituting the value of α from Equation 18 gives:

$$V_{magic} = V_{T_0}\ln(A) + \frac{V_{BE_0}V_{T_0}\ln(A)}{(E_{GE} - V_{BE_0}) + V_{T_0}(\eta - 1)} \quad \text{(Eq. 20)}$$

Factoring out the expression $V_{T_0}$ ln(A) and rewriting the result gives:

$$V_{magic} = V_{T_0}\ln(A)\left(\frac{E_{GE} + V_{T_0}(\eta - 1)}{(E_{GE} - V_{BE_0}) + V_{T_0}(\eta - 1)}\right) \quad \text{(Eq. 21)}$$

For a constant value of current $I_1$ the expression (η−1) may be replaced with the expression η. For resistor $R_1$ and resistor $R_2$ where the thermal conductivity (TC) is non-zero, the expression (η−1) may be replaced by the expression (η−1+σ) where the Greek letter σ is equal to the thermal conductivity (expressed as a reciprocal of degrees Celsius) times the room temperature $T_0$ (expressed in degrees Celsius).

$$\sigma=(TC)(T_0) \quad \text{(Eq. 22)}$$

The selection of the design parameters using the analysis set forth above proceeds as follows. First, the value of resistance of resistor $R_1$ is set to be approximately equal to the base-emitter voltage $V_{BE\,Q1}$ of transistor $Q_1$ divided by the current $I_1$.

$$R_1 \cong \frac{V_{BEQ1}}{I_1} \quad \text{(Eq. 23)}$$

Then Equation 21 is used to find the area A from the desired value of output voltage $V_{OUT}$. Alternatively, Equation 21 can be used to find the value of output voltage $V_{OUT}$ from the desired value of area A.

Then Equation 18 is used to find the value of α. Then the value of resistance of resistor $R_2$ is determined from:

$$R_2=\alpha R_1 \quad \text{(Eq. 24)}$$

Then the value of resistance of resistor $R_3$ is determined from Equation 6:

$$R_3 \cong \frac{V_{OUT}}{2I_1} \quad \text{(Eq. 25)}$$

To illustrate the process of finding the design parameters as set forth above consider the following numerical example. Assume that the following values have been determined:

$E_{GE}$=1.17 volt
$V_{BE_0}$=0.65 volt
$I_1$=10.0 microamperes (μA)
A=10.0 square units of area
ρ=2
$V_{T_0}$=26 millivolts The value of resistance of resistor $R_1$ is determined by Equation 23 as follows:

$$R_1 = \frac{0.65 \text{ volt}}{10\ \mu \text{ amps}} = 65\text{k}\Omega \quad \text{(Eq. 26)}$$

Then the given values are used in Equation 21 to determine the $V_{magic}$ value for the output voltage $V_{OUT}$.

$$V_{magic}=V_{OUT}=0.131 \text{ volt} \quad \text{(Eq. 27)}$$

Equation 18 gives the following value for α:

$$\alpha=0.1099 \quad \text{(Eq. 28)}$$

Then Equation 24 gives:

$$R_2=\alpha R_1=(0.1099)(65\ \text{k}\Omega)=7.14\ \text{k}\Omega \quad \text{(Eq. 29)}$$

Then Equation 25 gives:

$$R_3\frac{V_{OUT}}{2I_1}=\frac{(0.131\ \text{volt})}{2(10.0\ \mu\ \text{amps})}=6.55\text{k}\Omega \quad \text{(Eq. 30)}$$

Table One below illustrates the variation of the value of output voltage $V_{magic}$ as a function of the area A of transistor $Q_2$.

TABLE ONE

| Area A in square units | 3.0 | 4.0 | 5.0 | 10.0 | 20.0 |
|---|---|---|---|---|---|
| $V_{magic}$ in millivolts | 62.5 | 78.9 | 91.6 | 131.0 | 171.0 |

The residual curvature in the output voltage $V_{OUT}$ is given by the equation:

$$V_{CURVE}=V_{OUT}-V_{magic} \quad \text{(Eq. 31)}$$

Equation 31 can also be expressed as:

$$V_{CURVE}=V_{T_0}\alpha(\eta-1)[(H-1)-H\ln(H)] \quad \text{(Eq. 32)}$$

This expression for $V_{CURVE}$ is similar to that for a prior art bandgap reference circuit except that the value of $V_{CURVE}$ is reduced by the factor of α. The percent of curvature to output voltage $V_{magic}$ is the same as the prior art.

Increasing the value of $V_{OUT}$ by increasing the ratio α will cause a negative temperature coefficient and vice versa. This result is opposite to that obtained from a prior art bandgap reference circuit. In a prior art bandgap reference circuit, the PTAT (Proportional to Absolute Temperature) voltage is scaled. In the bandgap reference circuit of the present invention, the base-emitter voltage ($V_{BE}$) is scaled. If one adds more PTAT voltage to the value of $V_{OUT}$ (by increasing the ratio α) then one obtains a higher value of $V_{OUT}$ and a positive temperature coefficient. If one adds more base-emitter voltage ($V_{BE}$) to the value of $V_{OUT}$, then one obtains a higher value of $V_{OUT}$ and a negative temperature coefficient.

FIG. 2 illustrates a schematic representation of a second embodiment of a low voltage bandgap reference circuit 200 constructed in accordance with the principles of the present invention. The input voltage $V_{IN}$ is connected to a first current source 210 that produces a current having a value of $I_1$ and to a second current source 220 that also produces a current having a value of $I_1$ and to a third current source 230 that produces a current having a value of $I_2$. The input voltage $V_{IN}$ is also connected to the collector of bipolar junction transistor $Q_3$ and to the collector of bipolar junction transistor $Q_4$.

The output of first current source 210 is connected to the collector of bipolar junction transistor $Q_1$. The output of first current source 210 is also connected to the base of bipolar junction transistor $Q_4$. The emitter of bipolar junction transistor $Q_4$ is connected to the output voltage terminal $V_{OUT}$.

The output of second current source 220 is connected to the collector of bipolar junction transistor $Q_2$. The output of second current source 220 is also connected to the base of bipolar junction transistor $Q_3$. The emitter of bipolar junction transistor $Q_3$ is connected to a fourth current source 240 that produces a current having a value of $I_3$. The output of fourth current source 240 is connected to ground.

The base of bipolar junction transistor $Q_2$ is connected through resistor $R_2$ to the base of bipolar junction transistor $Q_1$. The output of third current source 230 is connected to the base of bipolar junction transistor $Q_2$.

The emitter of bipolar junction transistor $Q_1$ is connected to ground. A first end of resistor $R_1$ is connected to the base of bipolar junction transistor $Q_1$ and a second end of resistor $R_1$ is connected to ground.

The emitter of bipolar junction transistor $Q_2$ is connected to the voltage output terminal $V_{OUT}$. The emitter of bipolar junction transistor $Q_2$ is also connected through resistor $R_3$ to ground.

The emitter of bipolar junction transistor $Q_5$ is connected to the base of bipolar junction transistor $Q_2$. The collector of bipolar junction transistor $Q_5$ is connected to ground. The base of bipolar junction transistor $Q_5$ is connected to a node between the emitter of bipolar junction transistor $Q_3$ and the fourth current source 240.

The area of transistor $Q_1$ is equal to a unit value of area. That is, the transistor $Q_1$ has a value of area equal to one square unit (designated "1x" in FIG. 2). The area of transistor $Q_2$ is equal to "A" times the area of transistor $Q_1$. That is, transistor $Q_2$ has a value of area equal to A square units of area (designated "Ax" in FIG. 2).

The second embodiment of the invention in the low power bandgap reference circuit 200 replaces the "diode" equivalent around the transistor $Q_2$ of bandgap reference circuit 100 with a "folded buffer" arrangement that comprises transistor $Q_3$ and transistor $Q_5$. This puts a value of voltage that is equal to ($V_{BE}+V_{OUT}$) on the collector of transistor $Q_1$ and on the collector of transistor $Q_2$.

Therefore, the minimum input voltage $V_{IN}$ in bandgap reference circuit 200 is less than the minimum input voltage $V_{IN}$ in bandgap reference circuit 100.

$$V_{IN}(\text{min})=V_{BE}+V_{SAT}+V_{OUT} \quad \text{(Eq. 33)}$$

The term $V_{BE}$ represents a value of base to emitter voltage of said first bipolar junction transistor $Q_1$. The term $V_{SAT}$ represents a minimum voltage required for the four current sources (210, 220, 230, 240). The term $V_{OUT}$ represents the output voltage.

Equation 7 gives the minimum input voltage $V_{IN}$ for the bandgap reference circuit 100.

$$V_{IN}(\text{min})=2V_{BE}+V_{SAT}+V_{OUT} \quad \text{(Eq. 7)}$$

In Equation 33 the output voltage $V_{OUT}$ can be as low as approximately one hundred millivolts (100 mV). A low value of $V_{OUT}$ in Equation 33 provides headroom for the fourth current source 240 that provides the 13 current.

The third current source 230 provides the $I_2$ current for resistor $R_1$ and transistor $Q_5$. In one advantageous embodiment the value of the $I_2$ current is given by:

$$I_2=\frac{V_{BEQ1\text{MAX}}}{R_{1\text{MIN}}}+I_1 \quad \text{(Eq. 34)}$$

This value of current for $I_2$ provides transistor $Q_5$ with a current that has a value of current that is equal to $I_1$. It is noted that compensation capacitors may be required in low voltage bandgap reference circuit 200.

The low voltage bandgap reference circuits of the present invention (100 and 200) have several advantages over prior art bandgap reference circuits. First, no start-up circuitry is required. Second, the error amplification function is carried out by NPN bipolar junction transistors. Third, the bandgap reference circuits of the present invention require fewer transistors than prior art circuits. Fourth, the bandgap reference circuits of the present invention require fewer resistors than prior art circuits.

The foregoing description has outlined in detail the features and technical advantages of the present invention so that persons who are skilled in the art may understand the advantages of the invention. Persons who are skilled in the art should appreciate that they may readily use the conception and the specific embodiment of the invention that is disclosed as a basis for modifying or designing other structures for carrying out the same purposes of the present invention. Persons who are skilled in the art should also realize that such equivalent constructions do not depart from the spirit and scope of the invention in its broadest form.

Although the present invention has been described with an exemplary embodiment, various changes and modifications may be suggested to one skilled in the art. It is intended that the present invention encompass such changes and modifications as fall within the scope of the appended claims.

What is claimed is:

1. A bandgap reference circuit, comprising:

a first current source having an input coupled to an input voltage;

a second current source having an input coupled to the input voltage;

a first bipolar junction transistor having a collector coupled to an output of the first current source;

a second bipolar junction transistor having a collector coupled to an output of the second current source and having an emitter coupled to an output voltage terminal;

a third bipolar junction transistor having a collector coupled to the input voltage and a base coupled to the output of the first current source;

a fourth bipolar junction transistor having a collector and a base coupled to an emitter of the third bipolar junction transistor and having an emitter coupled to the output voltage terminal; and a voltage divider circuit coupled between a base of the first bipolar junction transistor and a base of the second bipolar junction transistor.

2. The bandgap reference circuit of claim 1, wherein:

the first bipolar junction transistor has a first area; and the second bipolar junction transistor has a larger second area.

3. The bandgap reference circuit of claim 1, wherein the voltage divider circuit comprises:

a first resistor coupled between the base of the first bipolar junction transistor and ground; and a second resistor coupled between the base of the first bipolar junction transistor and the base of the second bipolar junction transistor.

4. The bandgap reference circuit of claim 3, wherein:

an emitter of the first bipolar junction transistor is coupled to ground; and the emitter of the second bipolar junction transistor is coupled to ground through a third resistor.

5. The bandgap reference circuit of claim 1, further comprising:

a fifth bipolar junction transistor having a collector coupled to the input voltage, an emitter coupled to the base of the second bipolar junction transistor, and a base coupled to the collector of the second bipolar transistor.

6. The bandgap reference circuit of claim 1, wherein a minimum value of the input voltage is given by an expression:

$$V_{IN}(\text{minimum})=2V_{BE}+V_{SAT}+V_{OUT}$$

where $V_{BE}$ represents a base-to-emitter voltage of the first bipolar junction transistor, $V_{SAT}$ represents a minimum voltage required to operate the first current source and the second current source, and $V_{OUT}$ represents an output voltage of the bandgap reference circuit.

7. The bandgap reference circuit of claim 6, wherein the minimum value of the input voltage is in a range of approximately 1.8 volt to 2 volts.

8. The bandgap reference circuit of claim 6, wherein a minimum value of the output voltage is approximately one hundred millivolts.

9. The bandgap reference circuit of claim 5, wherein the bandgap reference circuit is started by supplying current from the first current source and by supplying current from the second current source.

10. A bandgap reference circuit, comprising:

a first current source having an input coupled to an input voltage;

a second current source having an input coupled to the input voltage;

a first bipolar junction transistor having a collector coupled to an output of the first current source;

a second bipolar junction transistor having a collector coupled to an output of the second current source and having an emitter coupled to an output voltage terminal;

a third current source having an input coupled to the input voltage and having an output coupled to a base of the second bipolar junction transistor; and a voltage divider circuit coupled between a base of the first bipolar junction transistor and the base of the second bipolar junction transistor.

11. The bandgap reference circuit of claim 10, wherein:

the first bipolar junction transistor has a first area; and the second bipolar junction transistor has a larger second area.

12. The bandgap reference circuit of claim 10, wherein the voltage divider circuit comprises:

a first resistor coupled between the base of the first bipolar junction transistor and ground; and a second resistor coupled between the base of the first bipolar junction transistor and the base of the second bipolar junction transistor.

13. The bandgap reference circuit of claim 12, wherein:

an emitter of the first bipolar junction transistor is coupled to ground; and the emitter of the second bipolar junction transistor is coupled to ground through a third resistor.

14. The bandgap reference circuit of claim 10, further comprising:

a fourth current source having an output coupled to ground;

a third bipolar junction transistor having a collector coupled to the input voltage, an emitter coupled to an input of the fourth current source, and a base coupled to the collector of the second bipolar transistor;

a fourth bipolar junction transistor having a collector coupled to the input voltage, an emitter coupled to the output voltage terminal, and a base coupled to the output of the first current source; and a fifth bipolar junction transistor having an emitter coupled to the base of the second bipolar junction transistor, a base coupled to an input of the fourth current source, and a collector coupled to ground.

15. The bandgap reference circuit of claim 14, wherein a minimum value of the input voltage is given by an expression:

$$V_{IN}(\text{minimum})=V_{BE}+V_{SAT}+V_{OUT}$$

where $V_{BE}$ represents a base-to-emitter voltage of the first bipolar junction transistor, $V_{SAT}$ represents a minimum voltage required to operate the current sources, and $V_{OUT}$ represents an output voltage of the bandgap reference circuit.

16. The bandgap reference circuit of claim 15, wherein the minimum value of the input voltage is in a range of approximately 0.9 volts to 1 volt.

17. The bandgap reference circuit of claim 15, wherein a minimum value of the output voltage is approximately one hundred millivolts.

18. The bandgap reference circuit of claim 14, wherein the bandgap reference circuit is started by supplying currents from the current sources.

19. A bandgap reference circuit, comprising:

a first current source having an input coupled to an input voltage;

a second current source having an input coupled to the input voltage;

a first bipolar junction transistor having a collector coupled to an output of the first current source and having a first area;

a second bipolar junction transistor having a collector coupled to an output of the second current source, an emitter coupled to an output voltage terminal, and a second area larger than the first area;

a third current source having an input coupled to the input voltage and having an output coupled to a base of the second bipolar junction transistor;

a first resistor coupled between a base of the first bipolar junction transistor and ground; and a second resistor coupled between the base of the first bipolar junction transistor and a base of the second bipolar junction transistor;

wherein an output voltage of the bandgap reference circuit is based on a ratio of resistances of the first and second resistors.

20. The bandgap reference circuit of claim 19, wherein a minimum value of the output voltage is approximately one hundred millivolts.

* * * * *

UNITED STATES PATENT AND TRADEMARK OFFICE

CERTIFICATE OF CORRECTION

PATENT NO. : 7,408,400 B1
APPLICATION NO. : 11/504976
DATED : August 5, 2008
INVENTOR(S) : Frank DeStasi It is certified that error appears in the above-identified patent and that said Letters Patent is hereby corrected as shown below:

Column 5, delete Equation 15 and replace with

-- $V_{OUT} = \alpha\left[E_{GE} - H\left(E_{GE} - V_{BE_0}\right) + V_{T_0} H \ln(H) - \eta V_{T_0} H \ln(H)\right] + V_{T_0} H \ln(A)$ --; and Column 6, line 56, delete "p=2" and replace with --$\eta$=2--.

Signed and Sealed this

Thirteenth Day of January, 2009

JON W. DUDAS
*Director of the United States Patent and Trademark Office*